US007234596B2

(12) United States Patent
Lebras

(10) Patent No.: US 7,234,596 B2
(45) Date of Patent: Jun. 26, 2007

(54) CARTON AND CARTON BLANK

(75) Inventor: Philippe Lebras, Chateauroux (FR)

(73) Assignee: MeadWestvaco Packaging Systems, LLC, Glen Allen, VA (US)

( * ) Notice: Subject to any disclaimer, the term of this patent is extended or adjusted under 35 U.S.C. 154(b) by 0 days.

(21) Appl. No.: 11/020,740

(22) Filed: Dec. 23, 2004

(65) Prior Publication Data

US 2005/0173269 A1 Aug. 11, 2005

Related U.S. Application Data

(63) Continuation of application No. PCT/US2003/020216, filed on Jun. 26, 2003.

(30) Foreign Application Priority Data

Jun. 26, 2002 (GB) ..... 0214745.2
Jun. 26, 2002 (GB) ..... 0214819.5

(51) Int. Cl.
*B65D 75/00* (2006.01)
*B65D 43/08* (2006.01)
*B65D 43/14* (2006.01)
*B65D 5/46* (2006.01)

(52) U.S. Cl. ..... 206/427; 206/736; 229/123.2; 229/125.32; 229/117.17

(58) Field of Classification Search ..... 206/139, 206/192, 427, 430, 525, 525.1, 736; 229/123.2, 229/125.19, 125.32, 117.17, 164, 240, 211, 229/160.2
See application file for complete search history.

(56) References Cited

U.S. PATENT DOCUMENTS 2,116,431 A 5/1938 Greco et al.
2,567,832 A 9/1951 Vadner
2,597,848 A 5/1952 Reeser
2,703,197 A 3/1955 Brasch
3,744,700 A * 7/1973 Stegmann ..... 229/122.23
3,817,018 A * 6/1974 Vickers ..... 53/462
4,037,777 A 7/1977 Maughan
4,335,844 A * 6/1982 Egli ..... 229/123.2
4,482,090 A 11/1984 Milliens
4,715,493 A 12/1987 Dreyfus
4,871,067 A 10/1989 Valenti
4,967,901 A * 11/1990 Wood ..... 206/139
5,555,982 A 9/1996 Kuhn et al.
5,657,872 A 8/1997 Leftwich et al.
5,941,809 A 8/1999 Sainz et al.

(Continued)

FOREIGN PATENT DOCUMENTS

CA 922 280 A 9/1986

(Continued)

*Primary Examiner*—Mickey Yu
*Assistant Examiner*—J. Gregory Pickett
(74) *Attorney, Agent, or Firm*—Tsugihiko Suzuki

(57) ABSTRACT

A carton and a blank for forming a carton including a tray portion with an open top and a cover connected to the tray portion to close the top of the tray portion. The tray portion has a pair of opposed end walls each having a hand aperture, and the cover has a pair of end flaps disposed internally of the end walls of the tray portion. Another aspect of the invention also covers a package including a carton referred to above and a collapsible carrier retained within the carton.

7 Claims, 11 Drawing Sheets

U.S. PATENT DOCUMENTS

| | | | | |
|---|---|---|---|---|
| 6,027,017 | A * | 2/2000 | Kuhn et al. | 229/125.32 |
| 6,283,363 | B1 * | 9/2001 | Focke | 229/125.19 |

FOREIGN PATENT DOCUMENTS

| | | | |
|---|---|---|---|
| EP | 0 217 148 | A3 | 4/1987 |
| EP | 0 428 397 | B1 | 9/1996 |
| EP | 1 279 618 | A1 | 1/2003 |
| GB | 1 527 253 | A | 10/1978 |
| GB | 2 171 672 | B | 9/1986 |

* cited by examiner

CARTON AND CARTON BLANK

This is a continuation of international application No. PCT/US2003/020216, filed Jun. 26, 2003, which is hereby incorporated by reference.

BACKGROUND OF THE INVENTION

The invention relates to a two-part packaging case formed from paperboard or similar foldable sheet material for accommodating a group of articles for example bottles. It also covers a package with a collapsible carrier placed within the carton.

It is known to produce two-part cartons in packaging, see for example EP0428397; the benefit being that it is possible to use two blanks formed from different material. It is common to form a first blank to receive the articles and then apply the second blank in order to form fully enclosed packages. The second blank is commonly applied to the outer surface of the carton and is secured thereto, by glue or other suitable known securing means. One disadvantage of this process is that the cartons need to be secured laterally as well as longitudinally which increases the complexity of the packaging process.

The present invention and its preferred embodiments seek to overcome or at least mitigate the problems of the prior art.

SUMMARY OF THE INVENTION

A first aspect of the invention provides a carton for holding a plurality of articles including a tray portion with an open top and a cover connected to the tray portion to close the top of the tray portion, wherein the tray portion has a pair of opposed end walls each having a hand aperture and wherein the cover has a pair of end flaps disposed internally of the end walls of the tray portion. Preferably, the end flaps of the cover are disposed along the inner surfaces of the end walls to substantially close the hand apertures of the tray portion, wherein the end flaps are hinged to the cover to be yieldable in response to insertion of the user's hands into the apertures.

According to an optional feature of this aspect of the invention, the end flaps of the cover are interposed between the hand apertures and the packaged articles to protect the user's hands.

According to a further optional feature of this aspect of the invention, the cover has a pair of opposed side panels that are secured to the outer surface of the tray portion.

In some embodiments, there further comprises a reinforcing flap hingedly connected to the end wall and folded down in a flat face contacting relationship with the inner surface of the outer end wall, wherein the end flap engages the free edge of the reinforcing flap to restrict upward movement of the cover. Preferably, the reinforcing flap is placed in flat face contacting relationship with the end wall to reinforce the end wall around the hand aperture.

Preferably, the tray portion and cover are formed from first and second separate blanks respectively. More preferably, the first and second blanks are formed of different materials.

According to another optional feature of this aspect of the invention the cover has a tear strip to facilitate opening of the carton. Preferably, the tear strip extends transversely across a side wall panel of the cover.

A second aspect of the invention provides a blank for forming a tray portion as claimed in any preceding claim comprising a base wall panel, a first end wall and a second end wall hingedly connected to opposed side edges of the base wall panel and a second blank for forming the cover as claimed in any preceding claim.

A third aspect of the invention provides a method of constructing a package having a tray portion and a cover, which method comprises the steps of:

(i) forming the sides and ends of the tray portion;

(ii) securing the cover panel to the opposed sides of the tray portion; and (iii) inserting end flaps of the cover panel intermediate the ends of the tray portion and the articles.

A fourth aspect of the invention provides a package including a carton, articles arranged in rows and accommodated within the carton and a collapsible carrier folded into a flat collapsed condition and placed within the carton. Preferably the carrier may be placed between adjacent rows of articles. More preferably the carrier may have a self-erecting feature including an automatically flattening bottom. Optionally the carrier may have a carrying handle by which the carrier may be lifted. Preferably the carrier may comprise a basket-style carrier.

A fifth aspect of the invention provides a carton for holding a plurality of articles including a tray portion with an open top and a cover connected to the tray portion to close the top of the tray portion, wherein the tray portion has a pair of opposed end walls each having a hand aperture and wherein the cover has a pair of end flaps disposed internally of the end walls of the tray portion. Preferably, the end flaps of the cover are disposed along the inner surfaces of the end walls to substantially close the hand apertures of the tray portion, wherein the end flaps are hinged to the cover to be yieldable in response to insertion of the user's hands into the apertures.

According to an optional feature of this aspect of the invention, the end flaps of the cover are interposed between the hand apertures and the packaged articles to protect the user's hands.

According to a further optional feature of this aspect of the invention, the cover has a pair of opposed side panels that are secured to the outer surface of the tray portion.

In some embodiments, there further comprises a reinforcing flap hingedly connected to the end wall and folded down in a flat face contacting relationship with the inner surface of the outer end wall, wherein the end flap engages the free edge of the reinforcing flap to restrict upward movement of the cover. Preferably, the reinforcing flap is placed in flat face contacting relationship with the end wall to reinforce the end wall around the hand aperture.

Preferably, the tray portion and cover are formed from first and second separate blanks respectively. More preferably, the first and second blanks are formed of different materials.

According to another optional feature of this aspect of the invention the cover has a tear strip to facilitate opening of the carton. Preferably, the tear strip extends transversely across a side wall panel of the cover.

A sixth aspect of the invention provides a blank for forming a tray portion as claimed in any preceding claim comprising a base wall panel, a first end wall and a second end wall hingedly connected to opposed side edges of the base wall panel and a second blank for forming the cover as described above.

A seventh aspect of the invention provides a method of constructing a package having a tray portion and a cover, which method comprises the steps of:

(i) forming the sides and ends of the tray portion;
(ii) securing the cover panel to the opposed sides of the tray portion; and
(iii) inserting end flaps of the cover panel intermediate the ends of the tray portion and the articles.

An eighth aspect of the present invention provides a package including a carton, first and second groups of articles accommodated within the carton and an erected carrier placed within the carton and loaded with the articles of the first group, wherein the articles of the second group are arranged to define a space for receiving the erected, loaded carrier.

BRIEF DESCRIPTION OF THE DRAWINGS

Exemplary embodiments will now be described, by way of example only, with reference to the accompanying drawings in which.

Figure 1:
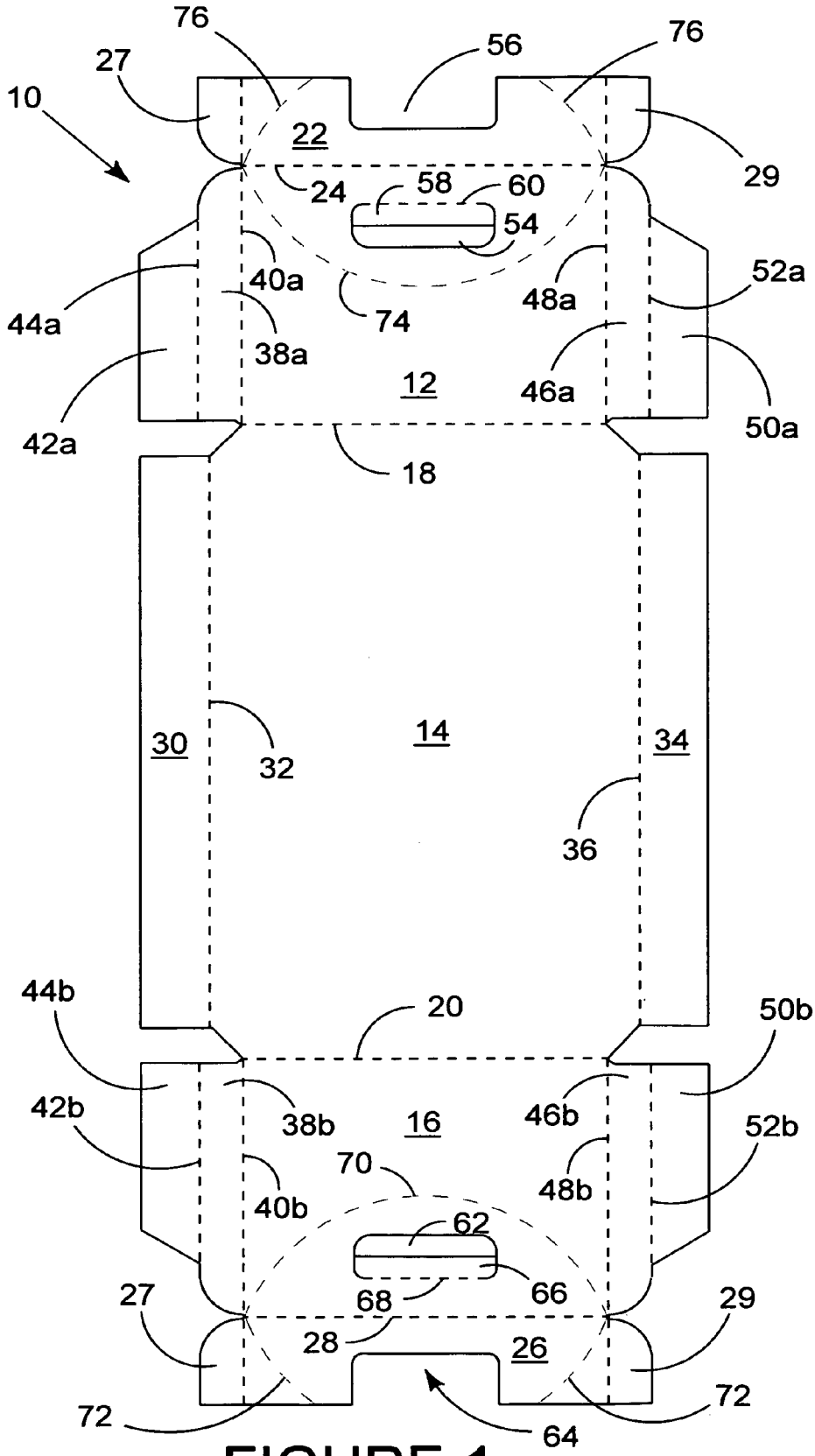
FIG. 1 is a plan view of a blank for forming a tray portion for a carton according to a preferred embodiment of the invention.
Figure 2:
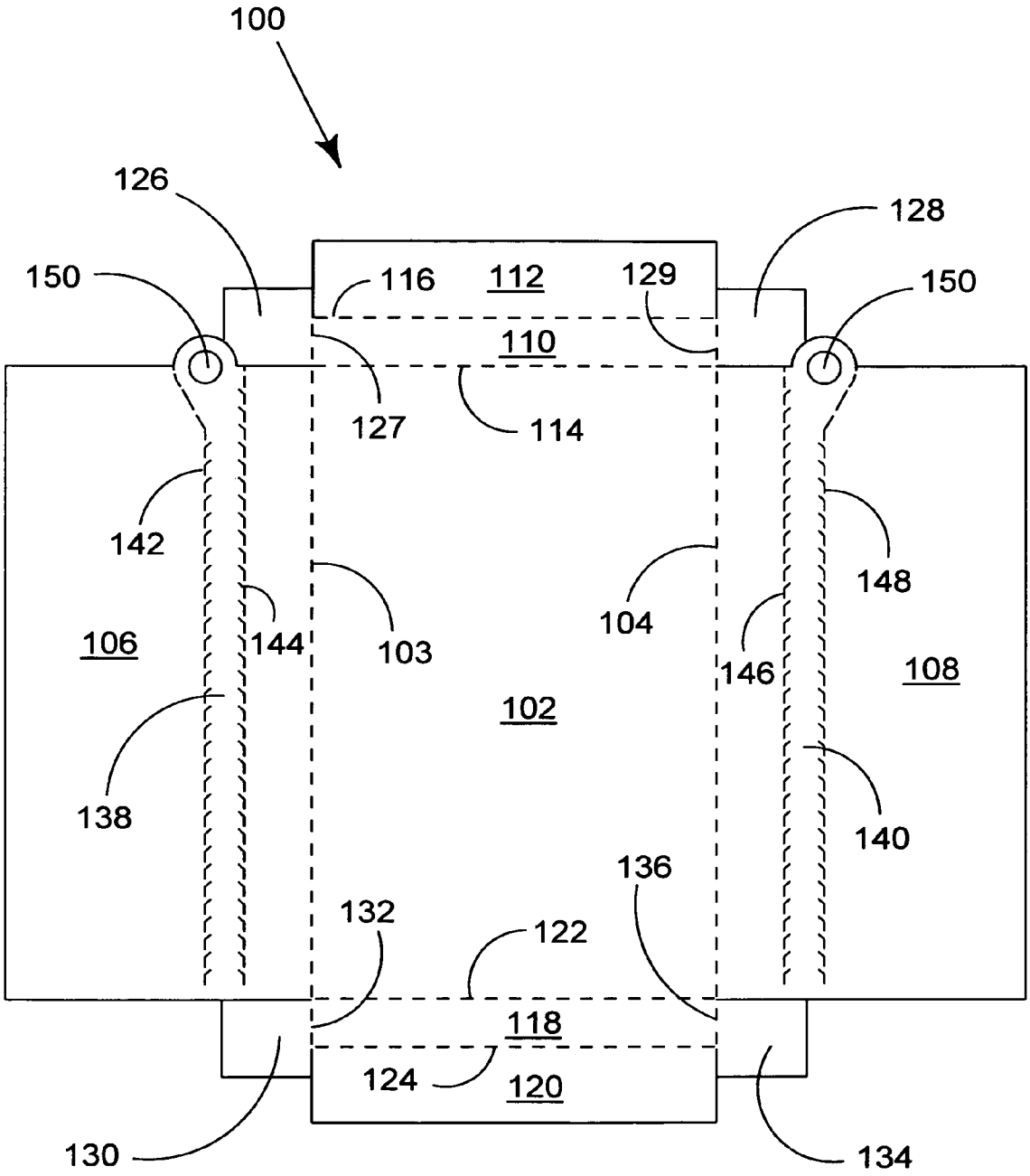
FIG. 2 is a plan view of a blank for forming the cover portion for a carton according to a preferred embodiment of the invention.

Referring to the drawings, and in particular FIGS. 1 and 2, there is shown a two part blank 10, 100 for forming a carton, each blank is made from paperboard or similar foldable sheet material, for example plastics or the like.

DETAILED DESCRIPTION OF THE PREFERRED EMBODIMENTS

Turning to the blank 10 for forming the tray portion T as shown in FIG. 1, there comprises a plurality of panels for forming the base and end wall structure. In this embodiment, there comprises a first end wall panel 12, a base wall panel 14 and a second end wall panel 16 hingedly connected one to the next along fold lines 18 and 20 respectively. Preferably, there further comprises opposed side wall panels 30 and 34 hingedly connected to the longitudinal edges of base wall panel 40 along fold lines 32 and 36 respectively.

In order to maintain the side wall panels in a set up condition, described in more detail below, there further comprises a support flap arrangement for connecting the end wall panel 12 to the respective ones of the side wall panels 30 and 34. The support flap structure, in this embodiment, comprises a support flap 42*a* hingedly connected to the end wall panel 12 along fold line 40*a*. Preferably there comprises a bevelled comer panel 38*a* forming part of the support structure which is positioned intermediate end wall panel 12 and support flap 42*a* and is hingedly connected thereto along fold line 44*a*.

The support flap structure for side wall 34, comprises a support flap 50*a* hingedly connected to the end wall panel 12 along fold line 48*a*. Again, there comprises a bevelled comer panel 46*a* forming part of the support structure which is positioned intermediate side wall panel 12 and support flap 50*a* and is hingedly connected thereto along fold line 52*a*.

Likewise, the opposing end wall structure is formed from a support flap arrangement which is identical to the arrangement described in the preceding two paragraphs. Therefore like references have been used with the affix 'b' and will not be described in any further detail.

In one class of embodiments, there further comprises reinforcing panels 22 and 26 hingedly connected to the first and second end wall panels 12 and 16 respectively along fold lines 24 and 28. Hand apertures 54 and 62 may be provided, struck from opposing end wall panels 12, 16 and each reinforcing panel further comprises a recess 56 and 64 so that in use, the reinforcing panels 22 and 26 surround the hand apertures 54 and 62 respectively but do not interfere with the apertures. Hand cushioning panels 58 and 66 are, optionally, provided and are hingedly connected to the respective end wall panels 12 and 16 along fold lines 60 and 68.

In those embodiments with bevelled comer panels 38*a*, 46*a*, there further comprises reinforcing flaps 27, 29 hinged to the side edges of reinforcing panels 22 and 26.

Crease lines 70, 72, 74 and 76 may be used to direct lifting stresses away from the handles in use.

The blank 100 for forming the cover C is illustrated in FIG. 2 in which there comprises a first side wall panel 106, a top panel 102 and a second side wall panel 108 hingedly connected one to the next along fold line 103 and 104 respectively. Preferably there comprises an inner end panel 112 and, optionally, a bevelled support panel 110 hingedly connected together along fold line 116 and connected to top wall panel 102 along fold line 114. Similarly, there comprises a second inner end wall panel 120 and, optionally, a bevelled support panel 118 hingedly connected together along fold line 124 and to top wall panel 102 along fold line 122.

In some embodiments, side support flaps, 126, 128, 130 and 134, are provided and are hingedly connected to the inner end wall panels 112 and 118 respectively along fold lines 127 and 129; 132 and 136.

In the embodiment of FIG. 2, there is also illustrated a pair of tear strips 138, 140 which are used to gain access to the interior of the set up carton. In use, each tear strip is provided with opposed tear lines 142, 144; 146, 148 running longitudinally along the side wall panels 106 and 108. Preferably there comprises a tab arrangement 150 at one end of the tear strip to help the user grip the tear strip.

In order to form the completed package from the blanks of FIGS. 1 and 2, a series of sequential folding and gluing operations are required and will be described further with reference to FIGS. 3 to 8 of the drawings. The folding and gluing operations can be performed in one or more straight-line machines, so that the carton is not required to be rotated or inverted to complete its construction. The folding process is not limited to that described below and can be altered according to particular manufacturing requirements.

The first stage in the construction of the carton from the blank shown in FIGS. 1 and 2, is for the tray portion T to be formed whereby the end wall panels 12 and 16 are folded inwardly along fold line 18 and 20. In addition, the side support structures are formed whereby support flaps 42*a*, 50, 42*b* and 50*b* are folded inwardly together with respective bevelled corner panels along the adjacent fold line 40, 44*a*; 48*a*, 52*a*; 40*b*, 42*b*; 48*b*, 52*b*. Thereafter, side wall panels 30 and 34 are folded inwardly along fold lines 32 and 36 respectively and are secured to the respective support flaps 42*a*, 42*b*; 50*a*, 50*b*. The tray T is in a set-up condition as shown in FIG. 3.

Figure 3:
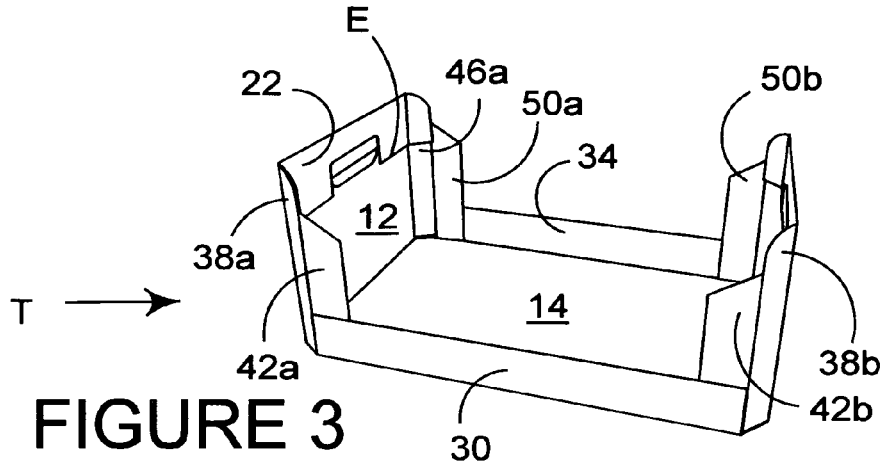
FIGS. 3, 4 and 5 illustrate the construction of the carton from the blanks of FIGS. 1 and 2.
Figure 4:
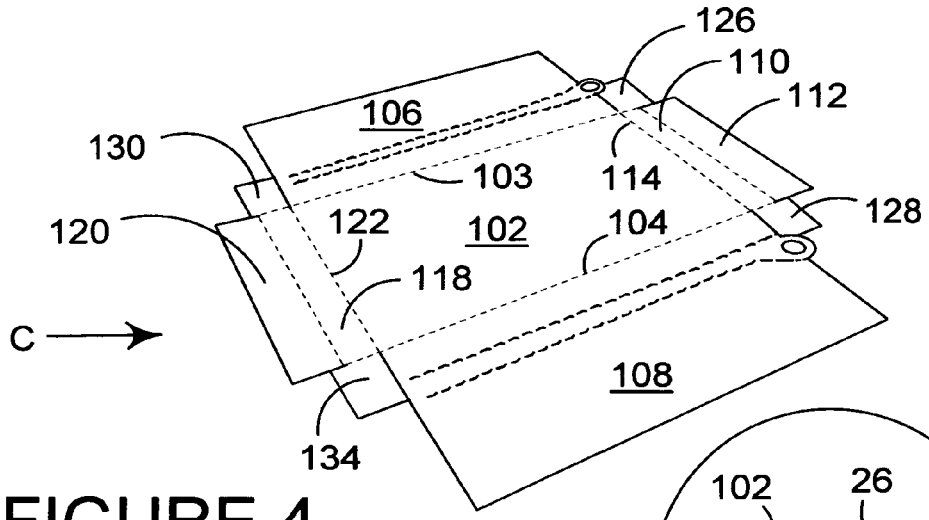

In those embodiments, with reinforcing panels 22 and 26, the reinforcing panels are folded inwardly along fold lines 24 and 28 respectively and into face contacting arrangement with the respective side wall panels 12 and 16 shown in FIG. 3. Similarly the reinforcing flaps 27, 29 are placed in face contacting arrangement with the bevel panels 38 and 46, so that the free end edge E of the reinforcing panels 22 and 26 are positioned within the carton.

Thereafter, the articles are loaded onto the tray portion T by a relative vertical movement between the bottles and the tray portion, as is well known. The cover portion C (shown in FIG. 4) is applied to the tray portion, whereby the first side wall panel 106 is secured to side wall panel 34 of the tray portion T. The top panel 102 is folded out of alignment with side wall panel 106 along fold line 103 and the inner end wall structures are formed by folding inner end wall panels 112 and 120 and bevel panels 110, 118, inwardly along fold lines 114 and 122 respectively.

In those embodiments with side support flaps 126, 128, 130 and 134, they are folded inwardly into face contacting arrangement with the respective side wall panels 106 and 108.

Figure 5A:
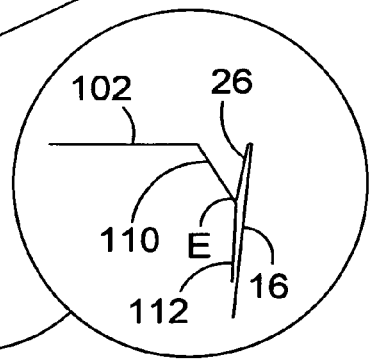
FIG. 5A is a cross-section of part of the carton shown in FIG. 5 illustrating the end wall arrangement of the tray and cover.
Figure 5:
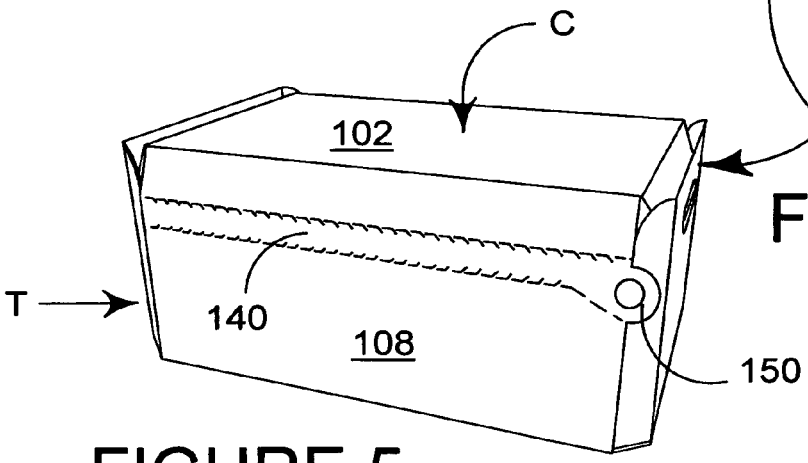

The inner end wall panels 112, 120 are then inserted within the tray portion intermediate the articles A and the end walls 12, 14 of the tray portion T. Finally, the side wall panel 108 is folded downwardly with respect to top wall panel 102 along fold line 104 to be secured to side wall panel 30 of the tray portion T so that the carton is in a set up and loaded condition as shown in FIG. 5. One advantage of this arrangement is that the cover is secured to the tray portion T along the longitudinal edges only, thereby simplifying the packaging process.

In some embodiments, the inner end wall panels 112 and 120 of the cover C are adapted to engage the free end edges E of reinforcing panels 22 and 26, so as to limit upward movement of the cover panel C, thereby to provide a more rigid arrangement. This arrangement is illustrated in FIG. 5*a*.

A further advantage of the arrangement shown in FIG. 5 is that the inner end panels 112 and 114 of the cover are disposed along the inner surfaces of the outer end wall panels 12 and 14 to close the hand apertures A of the tray portion T. The inner end wall panels 112 and 120 are hinged at the cover C so as to be yieldable in response to the insertion of the user's hands into the apertures. A further benefit of these inner end walls is that they are used to protect the user's hands from contact with the bottles, which is important where crown corks are used.

Figure 6:
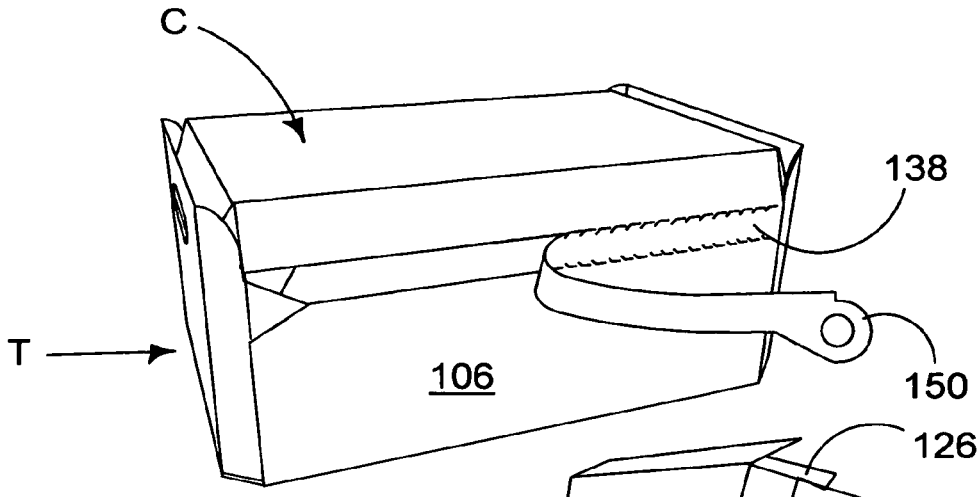
FIGS. 6 and 7 illustrate the cover being opened to gain access to the articles within the carton.
Figure 7:
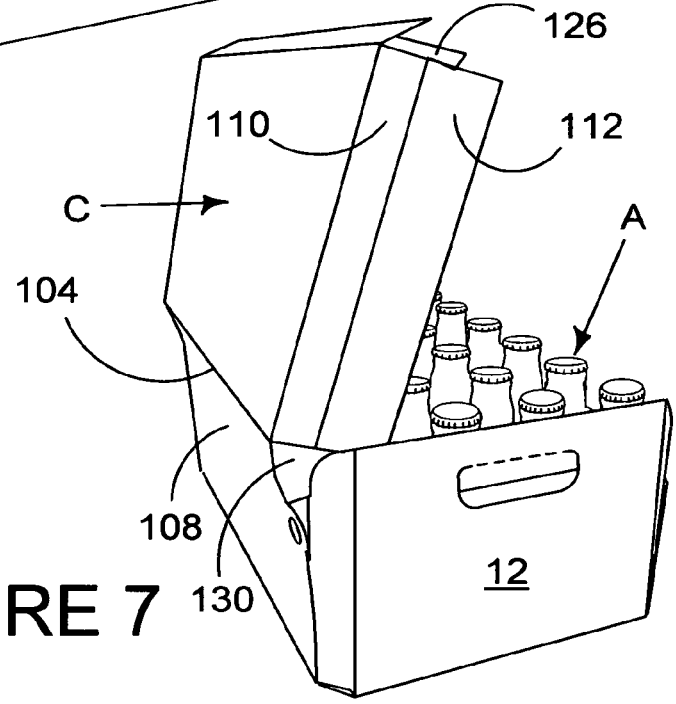
Figure 8:
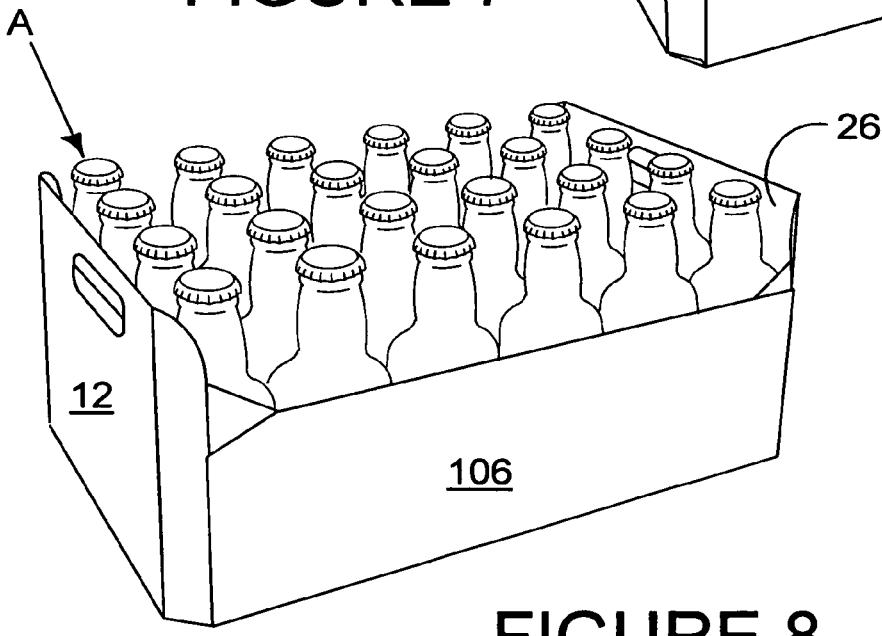
FIG. 8 illustrates the tray portion of the carton shown in FIG. 5.

FIGS. 6, 7 and 8 illustrate how to gain access to the interior of the carton so that the user grips tab arrangement 150 and tears the tear strip 138 along tear lines 142 and 140 as shown in FIG. 6. The cover C can be folded upwardly along fold line 104 to reveal the contents of the carton. It is also possible to remove the cover C completely by removing the other tear strip 140 so that the tray portion is revealed, shown in FIG. 8. It will be seen that the side wall panels are raised because of the two ply structure formed from side wall panels 106, 108 and inner side wall panels 30 and 34 of the tray portion.

Figure 9:
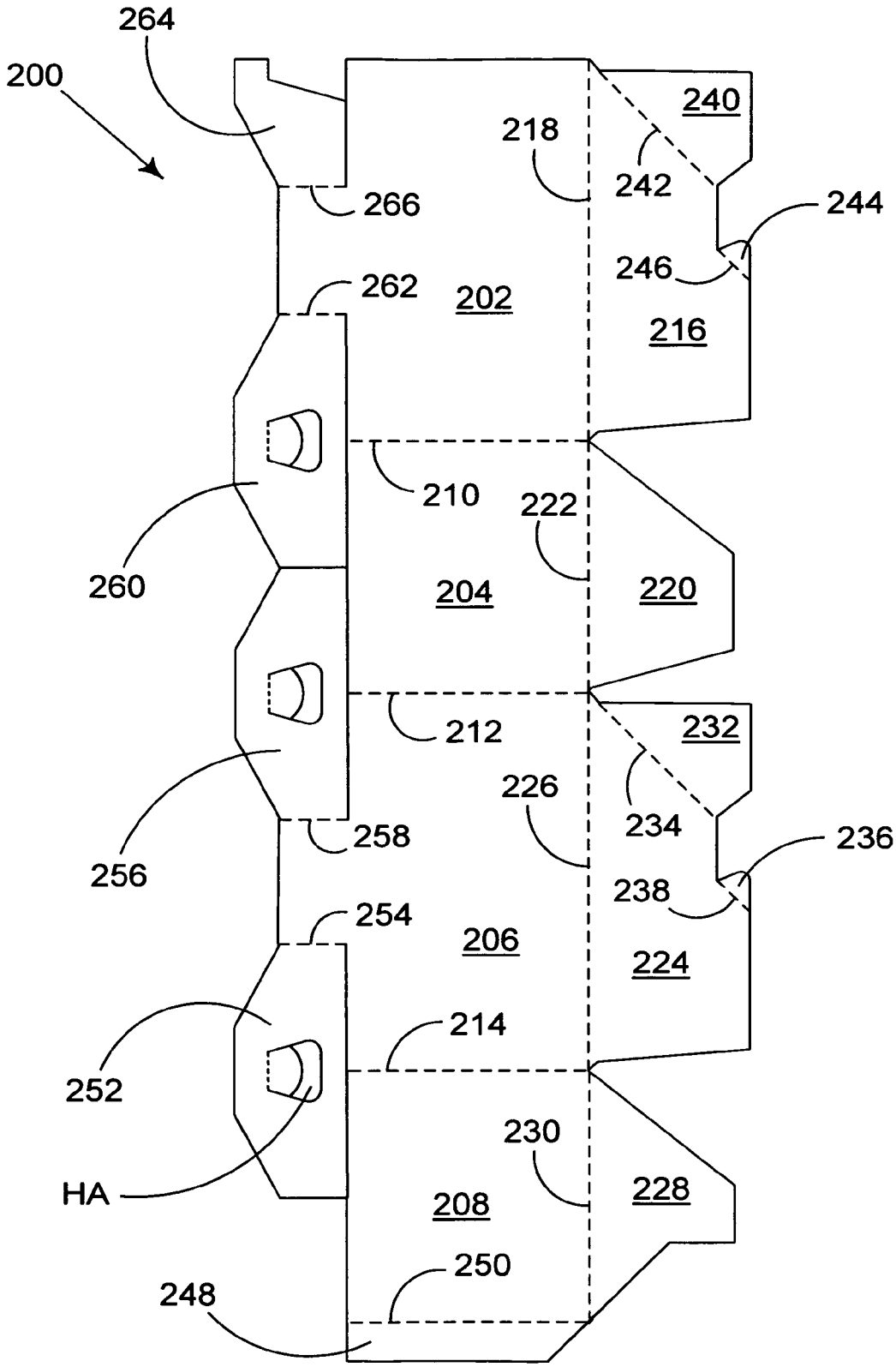
FIGS. 9 and 10 are plan views of two embodiments of collapsible carrier.
Figure 10:
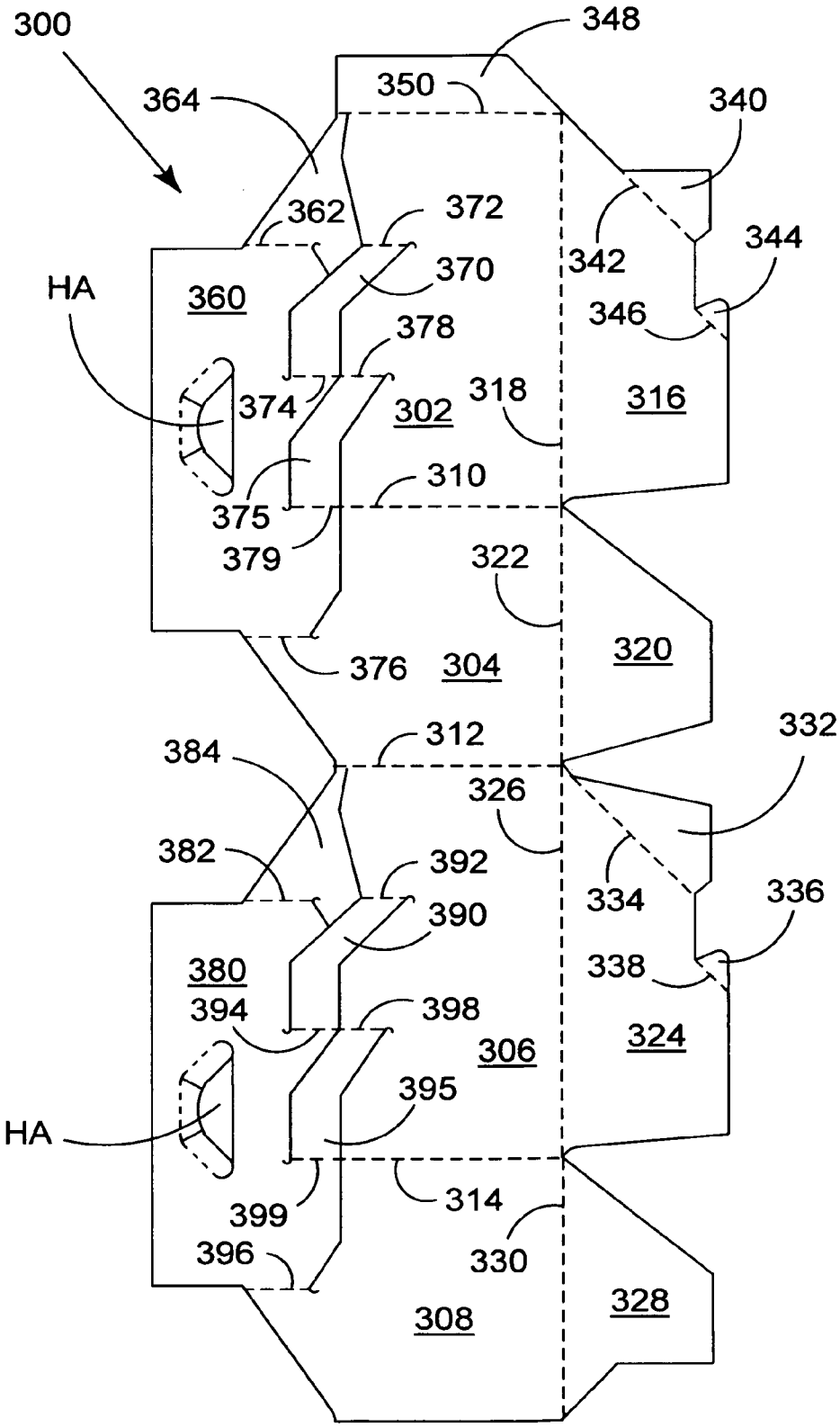

The blanks of FIGS. 9 and 10 illustrate two examples of a collapsible article carrier that can be placed within the carton from the blanks of FIGS. 1 and 2 and adapted to carry some of the articles from the carton.

Turning to the embodiment as illustrated in FIG. 9, the blank 200 is made from paperboard or other suitable foldable sheet material and comprises a plurality of panels forming the side, end and base of the carrier. In this embodiment, there comprises a first side wall panel 202, a first end wall panel 204, second side wall panel 206 and a second end wall panel 208 hingedly connected one to the next along fold lines 210, 212, 214.

The base structure is formed from a first base wall panel 216, hingedly connected to the first side wall panel 202 along fold line 218 and a second base wall panel 224 hingedly connected to the second side wall panel 206 along fold line 226. Preferably there further comprises end support flaps 220 and 228 hingedly connected to the respective end wall panels 204 and 208 along fold lines 222 and 230 respectively.

In the embodiment of FIG. 9, the base wall structure is automatically formed when the carrier is erected by an overlapping panel arrangement so that there comprises first and second flaps 232 and 236 hingedly connected to second base wall panel 224 along fold lines 234 and 238 respectively. There further comprises third and forth flaps 240, 244 hingedly connected to first base wall panel 216 along fold lines 242 and 246.

A handle structure is provided in which there comprises a multi-part handle. In FIG. 9, there is shown first handle panel 252 hingedly connected to second side wall panel 206 along fold line 254. A second handle panel 256 is hingedly connected to second side wall panel 206 along fold line 258 being spaced from first handle panel fold line 254. Inner support panels 260 and 264 are hingedly connected to first side wall panel 202 along fold lines 262 and 266 respectively.

There further comprises hand apertures HA formed in the respective handle panels 252, 256 and support panel 260. A cushioning panel may be optionally provided. In order to secure the opposing ends of the blank together there further comprises a securing flap 248 hingedly connected to the second end wall panel 208 along fold line 250.

Turning to the carrier blank illustrated in FIG. 18 and designated by reference numeral 300, the side, ends and base structures are substantially the same as the embodiments shown in FIG. 9 whereby like references have been used with the prefix "3" rather than "2". Therefore, only the differences will be described in any greater detail.

In this embodiment the securing flap is hingedly connected to the first side wall panel 302 along fold line 350.

The handle structure of blank 300 is formed with a two-ply central handle arrangement and individual cells. A first handle panel 360 is hingedly connected to first end wall panel 304 along fold line 376 and to inner second end wall panel 364 along fold line 362. The individual cells are formed from transverse partition panels 370, 375 hingedly connected to first side wall panel 302 along fold lines 370 and 378 and to handle panel 360 along fold lines 374 and 379 respectively. A hand aperture HA and cushioning panel(s) is provided.

A second handle panel 380 is hingedly connected to second end wall panel 308 along fold line 396 and to inner second end wall panel 384 along fold line 382. The individual cells are formed from transverse partition panels 390, 395 hingedly connected to second side wall panel 306 along fold lines 390 and 398 and to handle panel 380 along fold lines 394 and 399 respectively. Similarly, a hand aperture HA and cushioning panel(s) is provided.

Figure 11A:
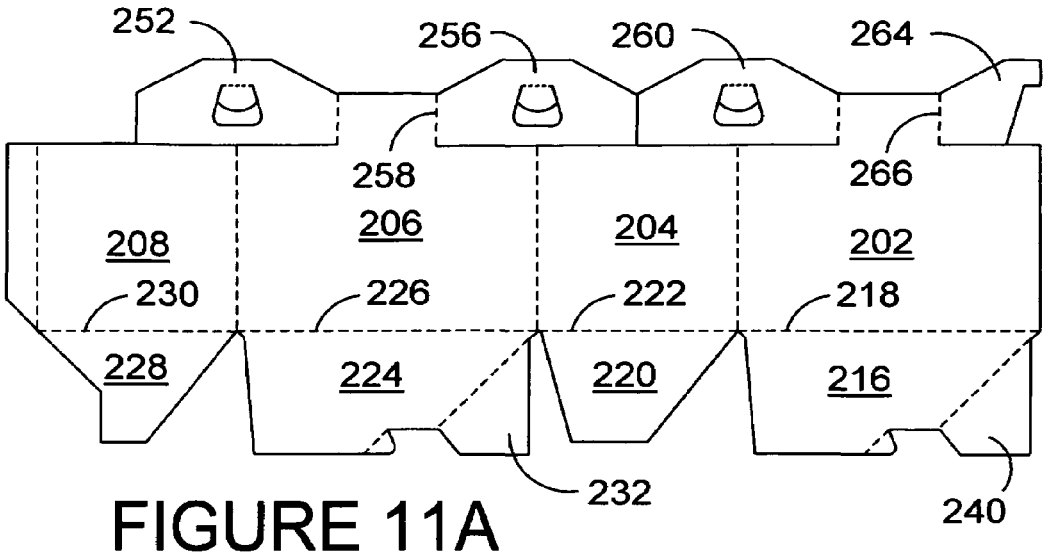
FIGS. 11A, 11B and 11C illustrate the construction of the carrier from the blank of FIG. 9.
Figure 11B:
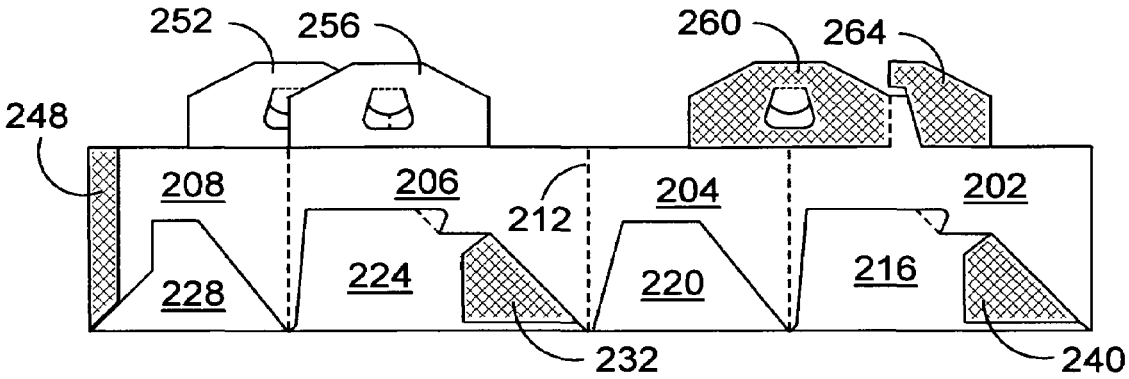
Figure 11C:
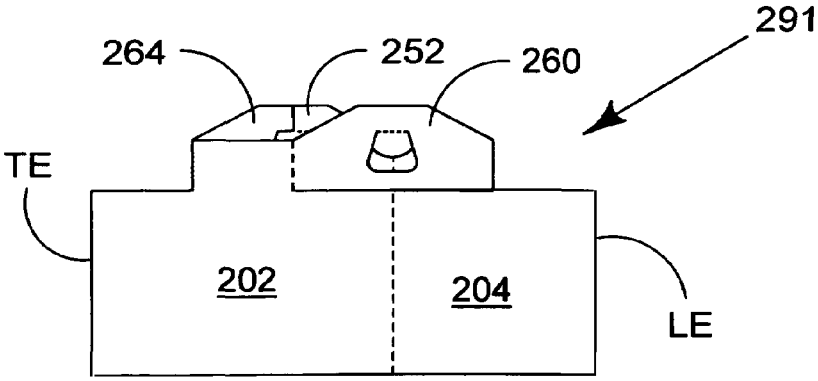

To construct the carrier of FIG. 9, reference is now made to FIGS. 11A, 11B and 11C, whereby the handle support panel 264 is folded into face contacting arrangement with side wall panel 202 and handle panel 256 is similarly folded into face contacting arrangement with side wall panel 206 along fold line 258. The base panels 216, 220, 224, 228 are folded inwardly along fold lines 218, 222, 226 and 230 respectively, so the blank is in a condition shown in FIG. 11B.

The panels forming one side of the carton is folded over along fold line 212 and the base flaps 232 and 240 are glued (shown as cross hatching) to base panels 220 and 228 or otherwise secured by known securing means. Handle support panels 260 and 264 are secured to handle panels 252 and 256 respectively; and securing flap 248 is secured to side wall panel 202, so that the carrier 291 is in a flat collapsed condition as shown in FIG. 11C, ready to be inserted between the article rows in the tray portion T or erected to receive one or more articles A.

Figure 12A:
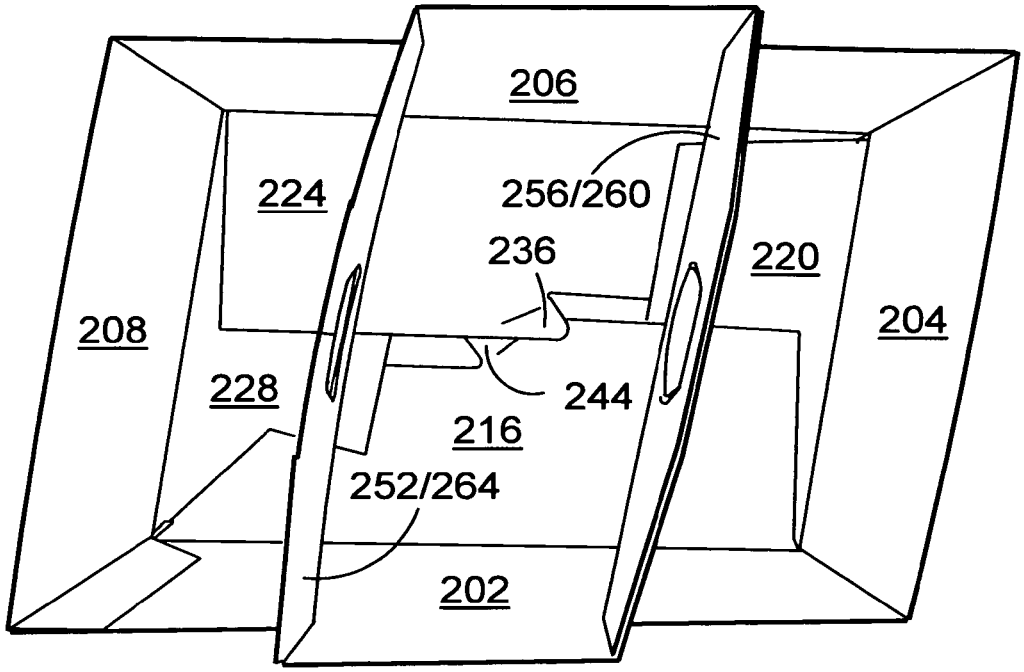
FIGS. 12A and 12B illustrate the construction of the base wall of the carrier of FIG. 9.
Figure 12B:
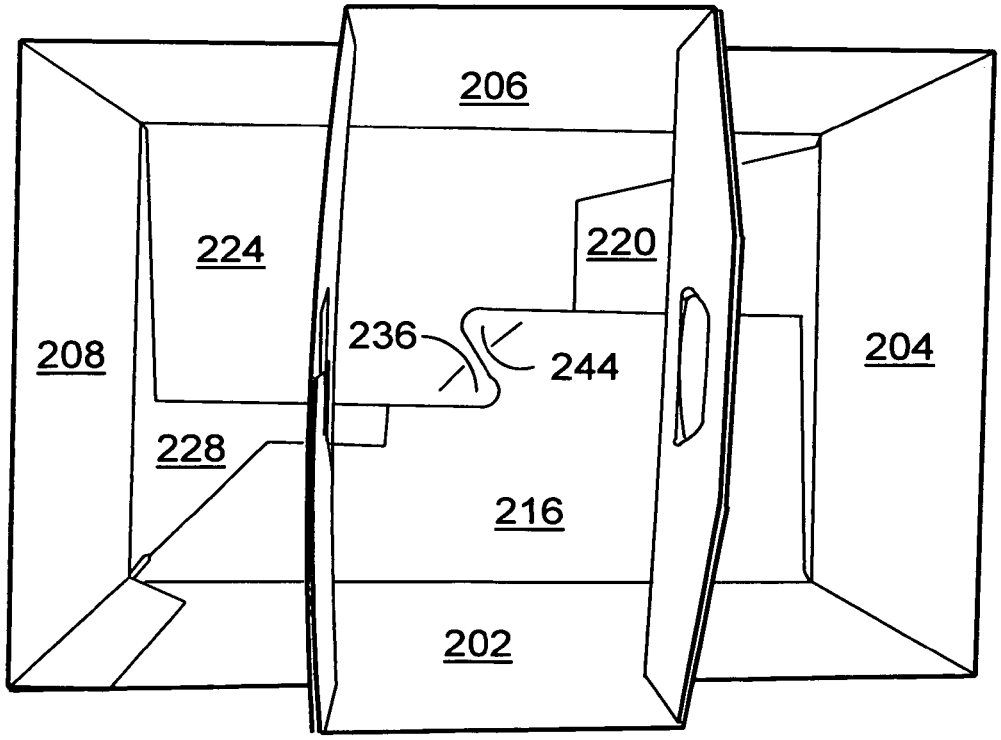

In order to erect the carrier CA, shown in FIGS. 12A and 12B, the side and end wall panels are moved apart, by pushing on the leading edge LE (FIG. 11C) and trailing edge TE (FIG. 11C), so that the carrier is folded along fold lines 210, 212, 214, 250 in to a substantially perpendicular arrangement, shown in FIG. 12A. At the same time, the base wall is automatically erected, because the panels 216, 228 and 224, 220 are forced downward in a downward direction as the side and end walls are formed. The flaps 236 and 244 are moved into overlapping arrangement and are interengaged, as shown in FIG. 12B. Thus the carrier is in a set up condition ready to be supplied to loaded with articles. It will be seen the handle arrangement defines a plurality of cells, by the spaced arrangement of handle panels 252 and 256.

Figure 13A:
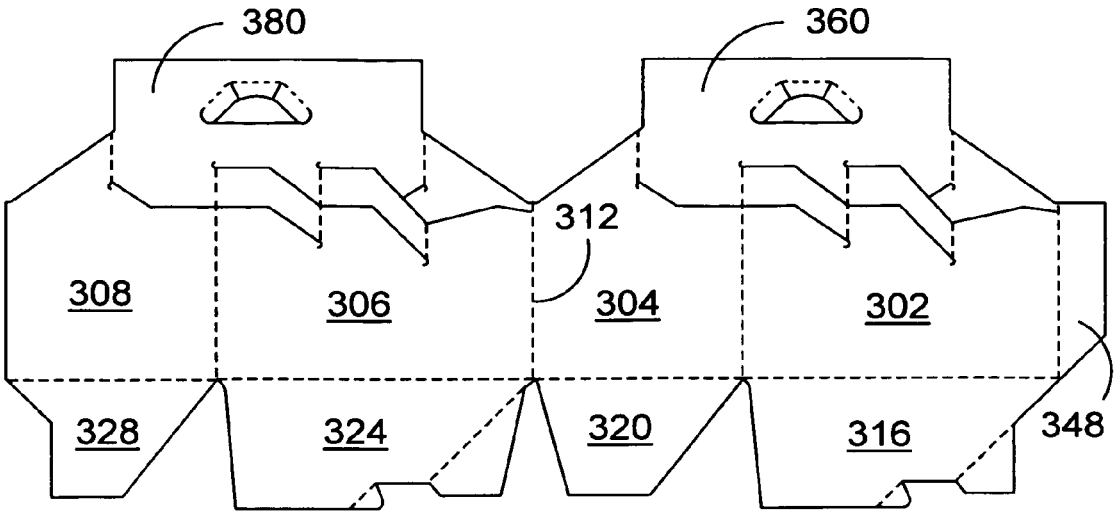
FIGS. 13A, 13B and 13C illustrate the construction of the carrier from the blank of FIG. 10.
Figure 13B:
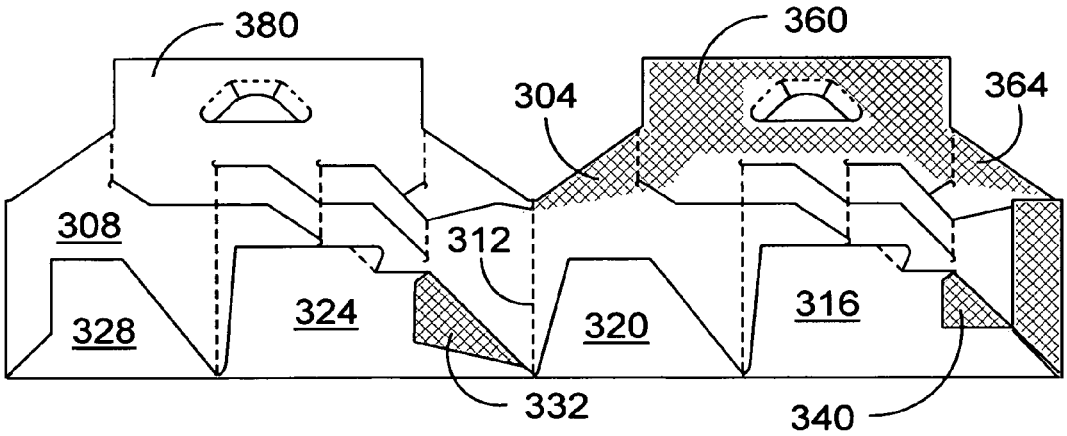
Figure 13C:
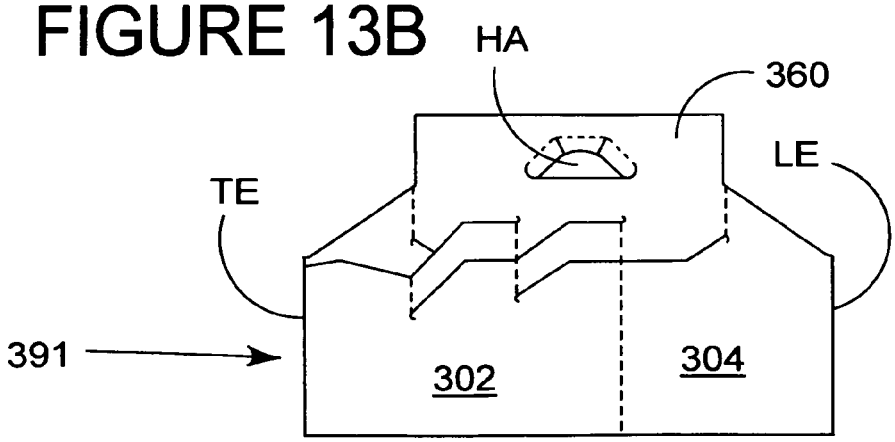

In order to construct the carrier of FIG. 10, reference is made to FIGS. 13A, 13B and 13C. The base panels 316, 320, 324, 328 are folded inwardly along fold lines 318, 322, 326 and 330 respectively, so the blank is in a condition shown in FIG. 13B. The first side wall panel 302, first end wall panel 304 and securing flap 348 are then folded about fold line 312 and into face contacting arrangement with the respective second end wall panel 308 and side wall panel 306 and the securing flap is secured to end wall panel 308 by glue (cross hatched in FIG. 13B) or other means known in the art. Handle panels 360 and 380 are secured together in face contacting arrangement by glue or other means known in the art. The base wall structure is formed whereby the base flaps 332 and 340 are glued (shown as cross hatching) to base panels 320 and 328 or otherwise secured by known securing means so that the carrier 391 is in a flat collapsed condition as shown in FIG. 13C, ready to be inserted between the article rows in the tray portion T or erected to receive one or more articles A.

In order to erect the carrier, the same method is used as for the embodiment of carrier and described with reference to FIGS. 12A and 12B and is not therefore described in any greater detail.

Figure 14:
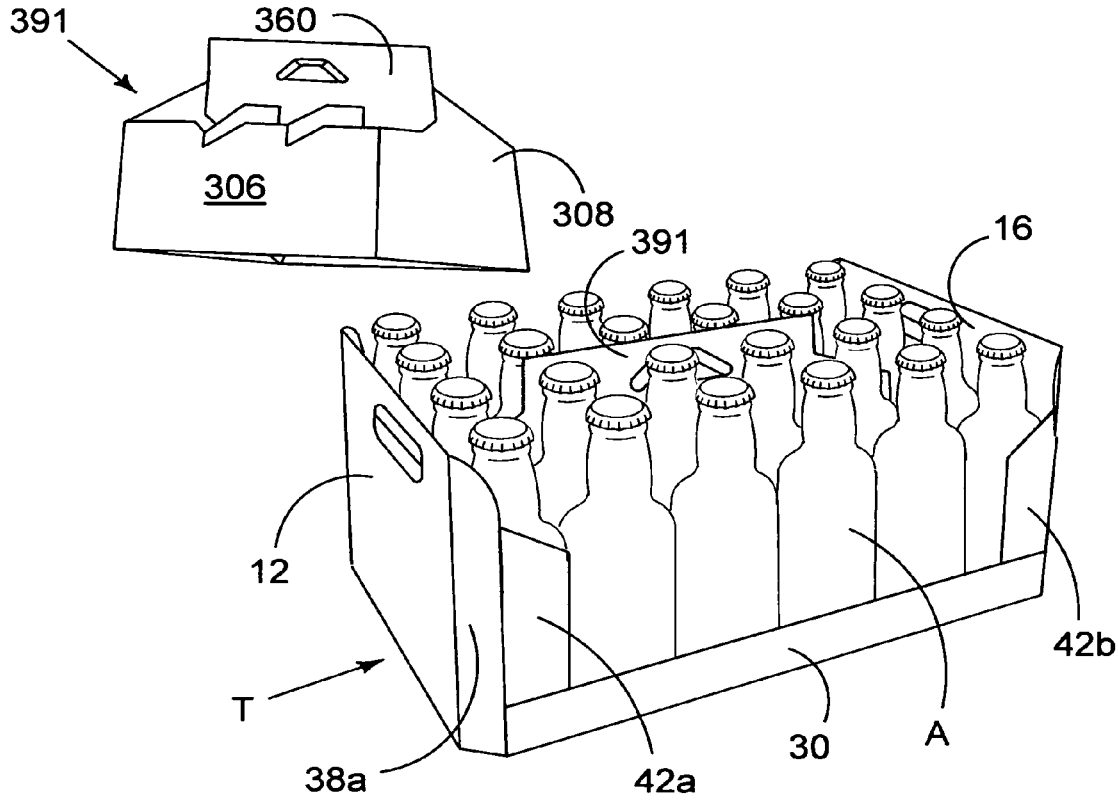
FIGS. 14, 16 and 17 illustrates the construction of the package including a tray and cover portion, and a collapsible carton.
Figure 15:
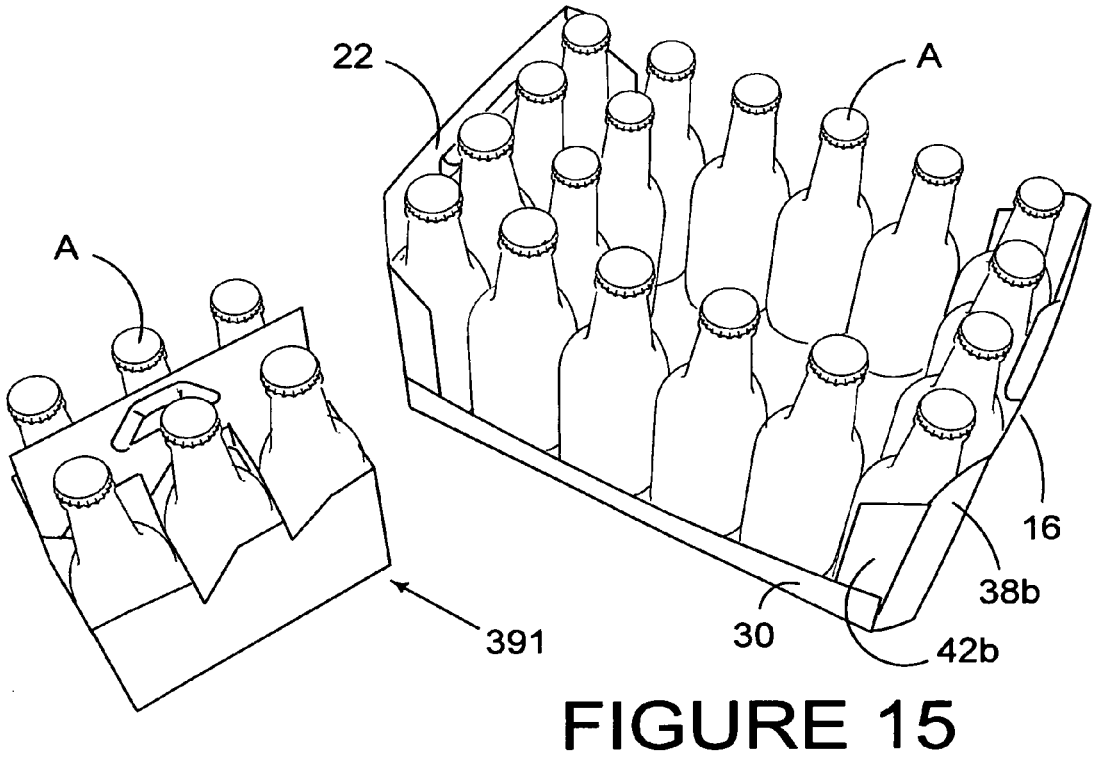
FIG. 15 illustrates the collapsible carrier of FIG. 13 and the tray portion.
Figure 16:
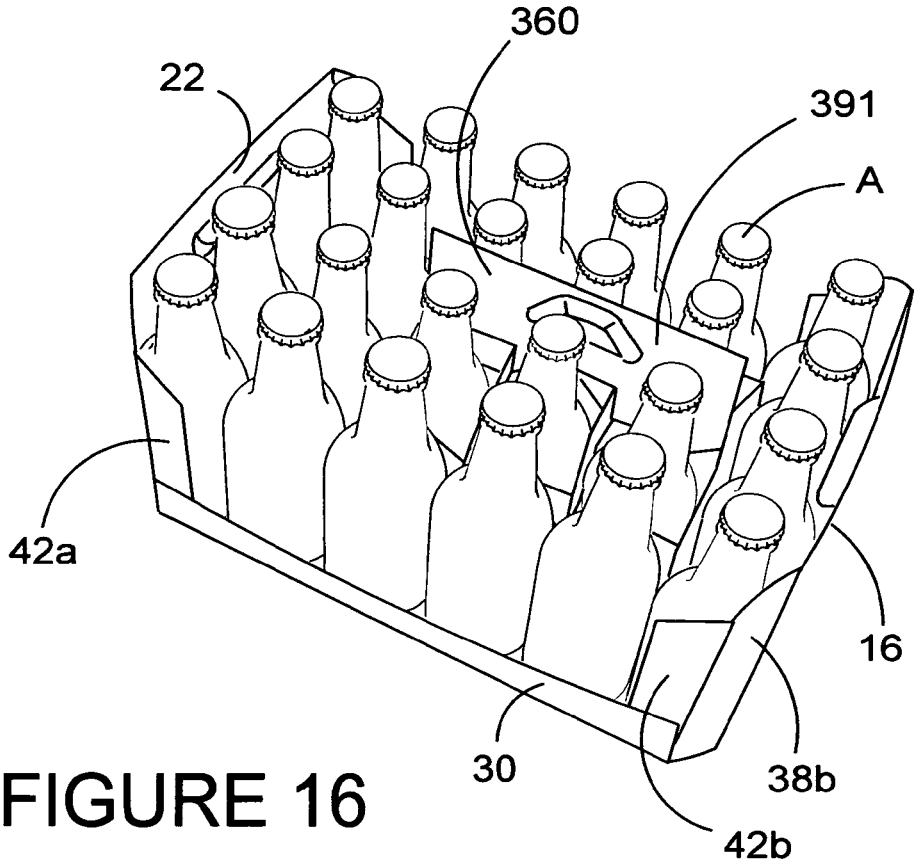

In one class of embodiments, the carriers 291, 391 are folded in a flat collapsed condition, slotted between adjacent rows of articles A. Thus they are held within a tray T as shown in FIGS. 8 and 14. Alternatively, the carriers 291, 391 are erected and loaded with an array of articles and applied to the tray T, shown in FIGS. 8, 15 and 16. Thus, the cover portion C is then applied to the tray portion in like manner to that described above, whereby the first side wall panel 106 is secured to side wall panel 34 of the tray portion T. The top panel 102 is folded out of alignment with side wall panel 106 along fold line 103 and the inner end wall structures are formed by folding inner end wall panels 112 and 120 and bevelled support panels 110, 118, inwardly along fold lines 114 and 122 respectively shown in FIG. 17.

Figure 17:
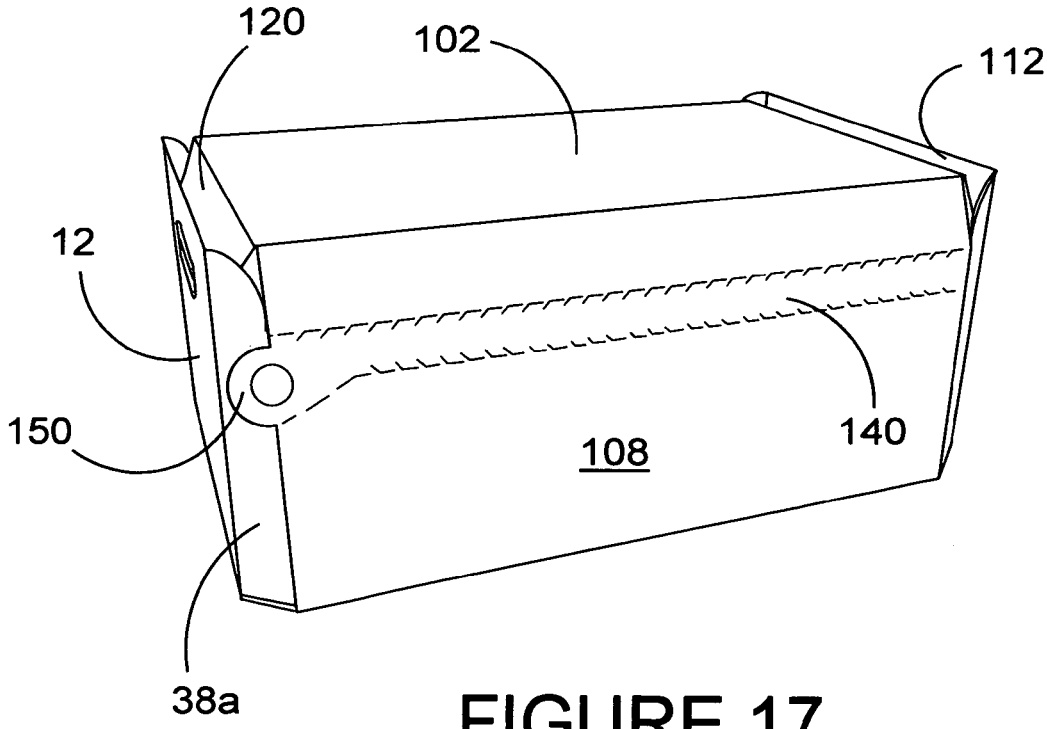

In order to gain access to the interior of the package of FIG. 17, the user grips tab arrangement 150 and tears the tear strip 138 along tear lines 142 and 140. The cover C can be folded upwardly along fold line 104 to reveal the contents of the tray. It is also possible to remove the cover C completely by removing the other tear strip 140 so that the tray portion is revealed.

The carrier 291 or 391 is removed from the tray portion and erected as previously outlined. It is then loaded with some articles A to serve as a shuttle pack so as to remove the desired quantity from the tray portion and convey them to the fridge, for example.

The present invention and its preferred embodiment relates to an arrangement for providing a reclosable access structure in a fully enclosed tray. However, it is anticipated that the invention can be applied to a variety of carriers and is not limited to those of the fully enclosed type hereinbefore described and could be used for numerous applications for example a two-part wraparound carton.

It will be recognised that as used herein, directional references such as "top", "base", "end", "side", "inner", "outer", "upper" and "lower" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a frangible line or a fold line, without departing from the scope of invention.

It should be understood that various changes may be made within the scope of the present invention, for example, the size and shape of the panels and apertures may be adjusted to accommodate articles of differing size or shape, alternative top and base closure structures may be used. The carton may accommodate more than one article in different arrays.

What is claimed is:

1. A carton for containing a group of similar articles, the carton comprising a top panel, a bottom panel, opposing side walls and opposing end walls, wherein the carton is constructed by combining first and second parts of a two-part blank, the first part comprising the bottom panel and the opposed end walls, each of the end walls having a hand aperture, the second part comprising the top panel, the opposed side walls and a pair of end flaps, each of the end flaps being hinged to the top panel and disposed internally of a respective one of the end walls, the each end flap engaging the first part thereby restricting upward movement of the top panel, wherein the each end flap of the second part is disposed along an inner surface of the respective end wall to substantially close the hand aperture in the respective end wall and wherein the end flaps are hinged to the top panel to be yieldable in response to insertion of a user's hands into the apertures.

2. A carton according to claim 1 wherein the each end flap is interposed between the hand aperture of the respective end wall and the packaged to protect a user's hands.

3. A carton according to claim 1 wherein the first part further comprises reinforcing flaps hinged respectively to the end walls, each of the reinforcing flaps being disposed in flat face contacting relationship with an inside face of the respective end wall to reinforce the respective end wall around the hand aperture.

4. A carton according to claim 1 wherein the first part further comprises a pair of opposed support flaps and the opposed side walls of the second part are secured to outside surfaces of the opposed support flaps.

5. A carton according to claim 1 wherein the first and second parts to the two-part blanks are formed of different materials.

6. A carton according to claim 1 wherein the second part further includes a tear strip to facilitate opening of the carton.

7. A carton for containing a group of similar articles, the carton comprising a top panel, a bottom panel, opposing side walls and opposing end walls, wherein the carton is constructed by combining first and second parts of a two-part blank, the first part comprising the bottom panel and the opposed end walls, each of the end walls having a hand aperture, the second part comprising the top panel, the opposed side walls and a pair of end flaps, the end flaps being hinged to the top panel and disposed internally of the end walls, wherein the first part further comprises reinforcing flaps hingedly connected to the end walls, each of the reinforcing flaps being disposed in flat face contacting relationship with an inside face of a respective one of the end walls to reinforce the respective end wall around the hand aperture, and the end flaps of the second part are disposed in engagement with the reinforcing flaps respectively, wherein the first part further comprising opposed support flaps, each of the opposed side walls being secured to an outside surface of a respective one of said opposed support flaps, wherein the each end flap of the second part is disposed along an inner surface of the respective end wall to substantially close the hand aperture in the respective end wall and wherein the end flaps are hinged to the top panel to be yieldable in response to insertion of a user's hands into the apertures.

* * * * *